US006209826B1

(12) United States Patent
Pratt, Jr.

(10) Patent No.: US 6,209,826 B1
(45) Date of Patent: Apr. 3, 2001

(54) GUTTER HANGER ASSEMBLY

(76) Inventor: John M. Pratt, Jr., 117 W. Wood Rd., Woodbury, CT (US) 36798

( * ) Notice: Subject to any disclaimer, the term of this patent is extended or adjusted under 35 U.S.C. 154(b) by 0 days.

(21) Appl. No.: 09/277,107

(22) Filed: Mar. 26, 1999

(51) Int. Cl.[7] ..... E04D 13/072

(52) U.S. Cl. ..... 248/48.2; 248/73; 248/231.9; 248/300; 52/11; 52/713; 52/702

(58) Field of Search ..... 248/48.2, 56, 73, 248/231.91, 300; 52/11, 713, 702

(56) References Cited

U.S. PATENT DOCUMENTS

| | | | |
|---|---|---|---|
| 1,573,449 | 2/1926 | Rachlin | 108/29 |
| 1,940,369 | 12/1933 | Peal | 108/29 |
| 2,895,694 | 7/1959 | Graving et al. | 248/48.1 |
| 3,053,491 | 9/1962 | Ramser | 248/48.2 |
| 3,416,760 | 12/1968 | Sauder | 248/48.2 |
| 4,210,301 * | 7/1980 | Weiss | 248/48.2 |
| 4,294,422 | 10/1981 | Odekirk | 248/48.1 |
| 4,345,731 * | 8/1982 | Rowe | 248/48.2 |
| 5,004,191 * | 4/1991 | Corry | 248/48.2 |
| 5,570,860 * | 11/1996 | Schoenherr | 248/48.2 |
| 5,737,879 * | 4/1998 | Sweet | 52/12 |

* cited by examiner

*Primary Examiner*—Leslie A. Braun
*Assistant Examiner*—A. Joseph Wujciak, III
(74) *Attorney, Agent, or Firm*—Dallett Hoopes

(57) ABSTRACT

The hanger body includes a hook for engaging the "Ogee" bead and a clip for slipping over the top edge of the rear wall of the gutter. It also includes a pair of upstruck tabs having openings at their upper ends semi-permanently supporting a fastener at an angle appropriate for driving. As the fastener is driven toward the clip in installation, it drives through the opening of the first tab, and collapses the second tab against the clip to serve as a washer and a reinforcement to better support the hanger and gutter.

10 Claims, 2 Drawing Sheets

FIG. 1
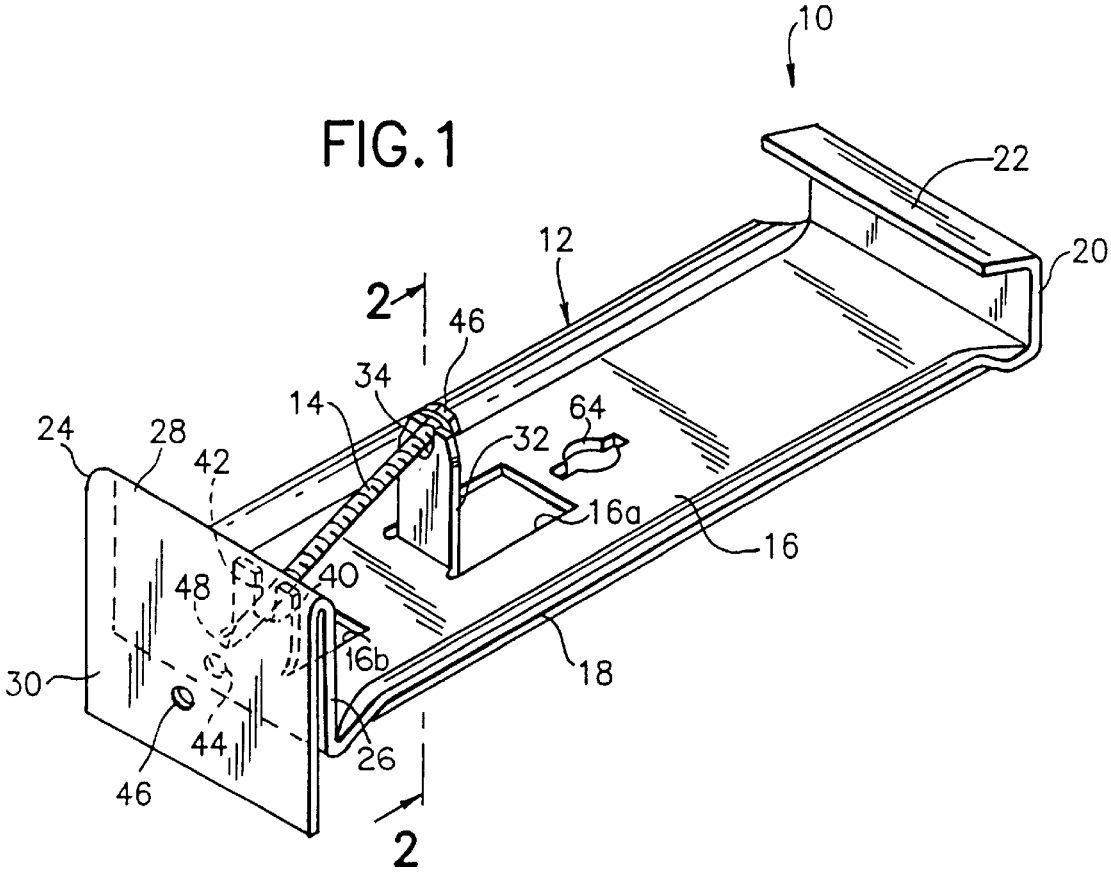
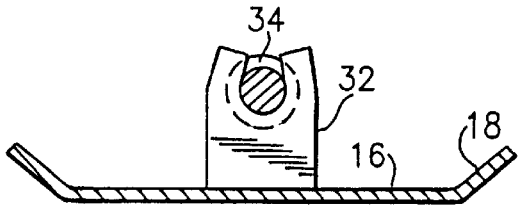
FIG. 2

GUTTER HANGER ASSEMBLY

FIELD OF THE INVENTION

This invention relates to a gutter hanger assembly. More specifically, the assembly is of the type which includes a hanger and a fastener held in the hanger in proper attitude to be engaged by an installing tool without the need for separately supporting the fastener during the attachment to a building.

BACKGROUND OF THE INVENTION

The prior art is replete with gutter hangers, some of which provide for fastener elements. One of the most common hangers has been the nail and ferrule type in which a ferrule is disposed between the front and rear walls of the gutter, and a nail is driven through the front wall, through the ferrule, through the rear wall and into the frieze board or fascia of the building structure. An example is shown in the old patent to Peal U.S. Pat. No. 1,940,369 issued Dec. 19, 1993.

There have also been strap type hangers wherein a brace extends across the top of the gutter and is centrally apertured to receive a hanger, an example being shown in the old Tangard U.S. Pat. No. 1,701,087 issued Feb. 5, 1929.

With the development of the "Ogee" gutter, hangers have sometimes comprised a bracket having a hook on its outer end adapted to engage into the reentrant pocket of the upper end of the front wall of the gutter. An inverted U-shaped clip has slipped over the top edge of the rear wall of the gutter, an example being shown in Sauder U.S. Pat. No. 3,416,760 issued Dec. 17, 1968.

More recently, the Odekirk U.S. Pat. No. 4,294,422 issued Oct. 13, 1981 discloses a gutter hanger comprising an "Ogee" bead engaging hook at its outer end and a clip at its inner end, the hanger body being zig-zag-shaped adjacent the clip and pierced to hold a nail in proper position for driving into the fascia board. This arrangement clearly requires extra material to hold the nail. The positioning appurtenance becomes part of the structural support after the hanger is installed.

An earlier patent to Ramser U.S. Pat. No. 3,053,491 issued Sep. 11, 1962, includes in the hanger an upstruck tab which may support an end of the nail at a proper driving angle. Ramser, however, does not contemplate holding means for the nail, merely a notched support for the nail once the gutter assembly is complete.

SUMMARY OF THE INVENTION

The present invention has for its object a hanger assembly which includes a substantially supported screw fastener held on the hanger body from factory-to-installer. The screw is held in the proper attitude for driving. The hanger assembly comprises a hanger body having a hook at one end adapted to engage the "Ogee" bead, and at the other end, an inverted U-shaped clip adapted to clip over and engage a rear wall of the gutter. The hanger body also includes a pair of upstruck tabs not part of the structural support. The tabs have openings at their tops adapted to semi-permanently support the fastener at an angle appropriate for driving toward and through the clip and rear wall of the gutter and into the fascia board. As the fastener head moves toward the clip, it pulls out of the opening of the first tab, engages the second tab and crimps the second tab against the clip to serve as a washer and a reinforcement to better support the hanger and gutter.

BRIEF DESCRIPTION OF THE DRAWINGS

Further objects and features of the invention will be clear to those skilled in the art from a review of the following specification and drawings, all of which present a non-limiting form of the invention. In the drawings:

FIG. 1 is a perspective view of a hanger embodying the invention;

FIG. 2 is a sectional view taken at the line 2—2 of FIG. 1;

DESCRIPTION OF THE PREFERRED EMBODIMENT

Figure 3:
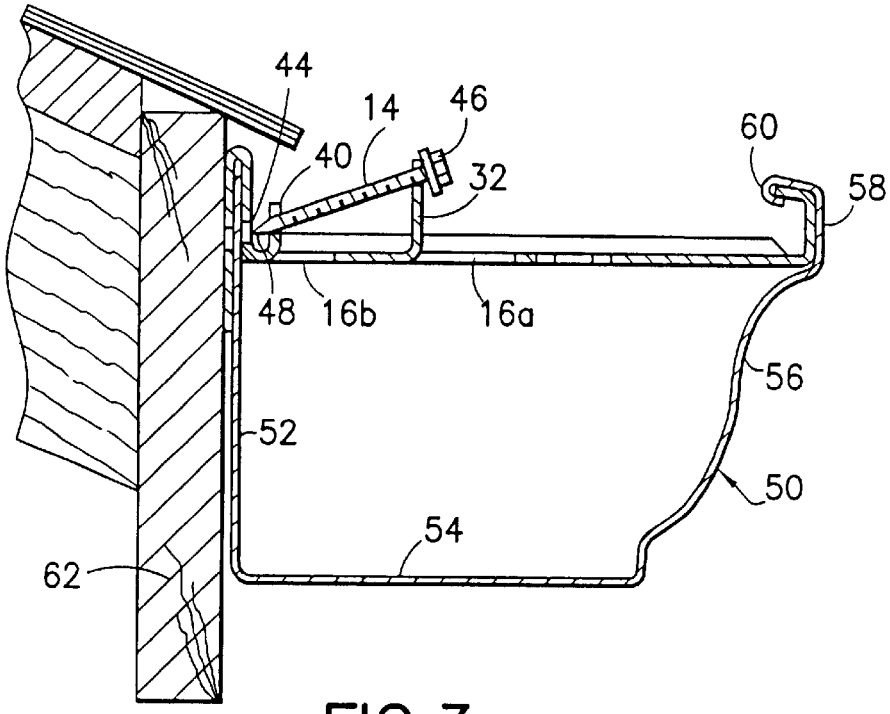
FIG. 3 is a transverse sectional view of a gutter having a hanger embodying the invention installed thereon prior to being attached to the building structure.

A hanger assembly embodying the invention is shown in FIG. 1 and generally designated 10. It comprises a hanger body 12 and a threaded fastener 14. The assembly shown is as it would appear when delivered to the installer.

The hanger body 12 comprises a generally rectangular flat element 16. For strength, the margins of the element 16 may be upturned in an inclined curb 18. On one end of the element is disposed an upward portion 20 having a doubled back hook portion 22. The other end is formed with an inverted U-shaped clip 24 which comprises an upward leg 26, an outward bight 28 and an extended downward leg 30. The flat element 16, the upward portion 20 and the inward hook 22, as well as the clip 24, are all unitarily formed, preferably of sheet metal.

The flat portion 16 is slitted in a U-shaped slit 16*a* and upstruck to form a vertical tab 32 formed with an opening 34 at its upper end.

Closer to the clip 28 the flat portion 16 is slitted in a U-shaped slit 16*b* and struck up to form a second tab 40 somewhat shorter than the first tab 32. It is formed with an opening 42 of U-shape (FIG. 1). The legs 26 and 30 are formed with fastener-receiving apertures 44 and 46. The fastener 14 is in the form of a self-tapping elongated screw, preferably having a hexagonal head 46 and a tapping point 48. Typically, the screw may be 2" long.

The opening 34 is preferably a notched V- or U-shaped. More generally, it is an open-topped opening. This, in concert with perforated tab 40, receives the fastener 14 and holds it so that its axis is directed toward the two apertures 44 and 46 in the clip 24. In assembly with the hanger, the fastener rests in the opening 34 and through perforation 42. The respective legs or bifurcations on opposite sides of the opening 34 (FIG. 2) are pinched together to retain the fastener in opening 34. As shown in FIG. 3, the point 48 of the self-tapping or sheet metal fastener 14 is preferably positioned adjacent the aperture 44.

Thus, when the installer receives the hanger assemblies 20, they are in the condition shown in FIG. 1 and it is only necessary for the installer to position the assemblies spaced along the gutter 50 and engage them with the gutter as described below.

As shown, the "Ogee" gutter has a rear wall 52, a bottom wall 54, and an "Ogee" curved front wall 56. At the upper end of the front wall 56 the gutter is formed with a "Ogee" bead 58 which is the traditional shape for giving strength and a smooth finish to the top edge of the gutter. It includes a substantially horizontal top surface and a re-entrant pocket 60.

Gutters, such as the one shown, are often fabricated from a roll of flat aluminum stock and are shaped by a forming machine on the site as they are uncoiled off the roll. Using the assembly of the invention, once the gutter is formed, the installer can simply hook the hook portion 22 into pocket 60 of the "Ogee" bead and then press the clip 24 down over the top of the rear wall 52. This motion is as described in the above-mentioned Sauder patent. Such installation of hanger assembly on the gutter may be done at spaced intervals which may be either uniform or unevenly spaced, depending, for instance, on the topography of the fascia 62 and the location of the rafters of the building structure.

Figure 4:
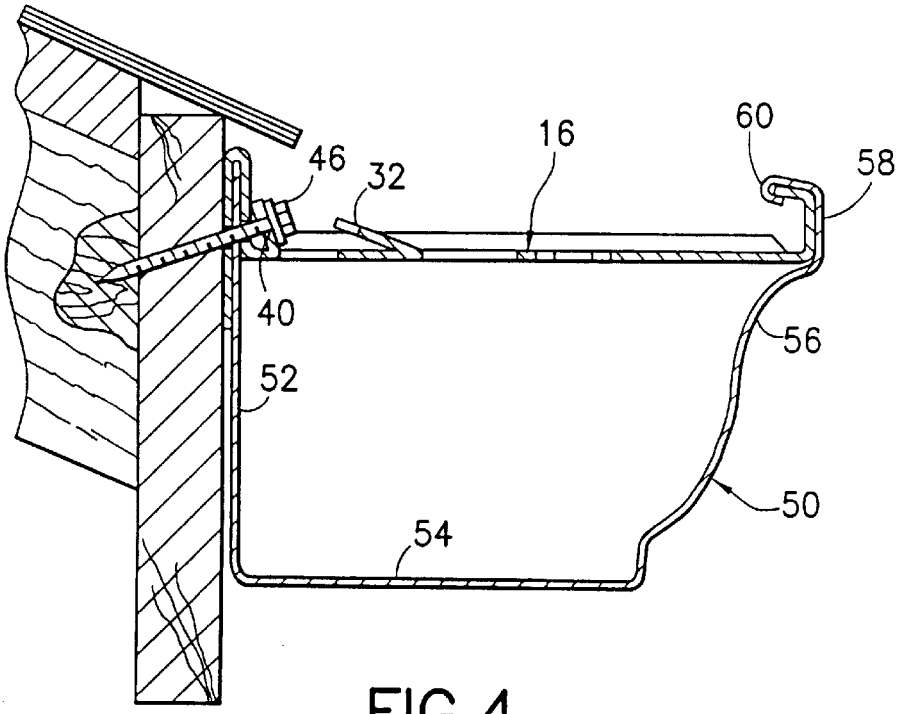
FIG. 4 is a view similar to FIG. 3 but showing the fastening means screwed on the way into the house as the structure appears in final disposition.

Once the assembly of the hanger with the gutter is complete, the installer merely engages the hex head 46 with the hexagonal socket drive of his power tool and activates the tool, pressing the tool toward the building structure. Under such pressing, the tab 32 yields, bending to the left (FIG. 3) whereupon the rotating point 48 enters the aperture 44 on leg 26, taps and threads its way into the previously imperforate rear wall 52, passes into the aperture 46 of the rear leg 30 and forcefully enters the fascia 62. The threads on the fastener 14, in engagement with the fascia, draw the fastener 14 axially into the fascia and away from the tab 32, the bent vestige of which remains harmlessly above the flat portion 16 (FIG. 4). (Alternatively, the lower end of tab 32 may be formed with a weakened line and the tab will break off.)

The head 46, as the fastener 14 is driven farther into the fascia, engages the tab 40 and bends it over (FIG. 4), giving it the incline of the head. The tab 40 ultimately serves as a washer and buttress or reinforcement and presses against the clip 24 and secures it and the gutter to the fascia. By engagement with the "Ogee" bead, the hanger pulls the outer wall 50 toward the building structure. The gutter assembly can thus withstand the outward force of water or ice within the gutter and maintain its original shape.

If desired or necessary, a central aperture 64 having diametrically opposite short outward wing slots can be formed in the hanger body 16 for the provision of a strap-like hanger having a "T"-shaped end. In most applications, such additional support is not necessary.

The hanger assembly of the present invention includes a pre-mounted threaded fastener held at the proper attitude for installation. The hanger assembly of the invention provides a semi-permanent support for the fastener without requiring additional material on the hanger body and requiring only a relatively short fastener. It requires no pre-formed openings in the gutter and, thus, gives the installer substantial discretion and latitude as to just where he puts the hanger spaced along the gutter, at what intervals. In addition, at least the inner one 40 of the support tabs for the fastener forms additional bracketing to better support the gutter after the inner tab collapses as the fastener is driven home.

This invention is not simply another variant form of a gutter hanger. The unique structure permits a more efficient use of sheet metal material and allows attachment with a shorter fastener than other current designs. The net effect is a lower cost for a given strength.

Variations in the invention are possible, such as substituting a nail in place of the screw. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A gutter hanger assembly comprising:

a. a main flat body having at one end an upwardly and inwardly turned hook portion adapted to hook into a gutter "Ogee" bead and at the other end an inverted U-shaped clip adapted to clip over and engage a rear wall of a gutter, the clip being formed with at least one aperture to receive a fastener, b. a pair of free-standing tabs struck upwardly from the main flat body and spaced longitudinally of the main flat body, the tabs having openings at the upper ends thereof, the opening in the tab closer to the clip being closer to the main flat body than the opening in the other tab, the opening in the other tab being open up-wardly, c. a fastener retained in the openings and having an axis directed toward and having a tip adjacent to the aperture in the clip whereby said tab which is closer to the clip is adapted to be bent over by forceful engagement by said fastener and is adapted to serve as a washer or buttress for the fastener as the fastener presses it against the clip when the fastener secures the gutter to a fascia.

2. A process for securing a rain gutter and attached hanger assembly to a building component, the hanger assembly comprising a hanger body secured across the gutter and having a pair of free-standing upward tabs disposed transverse to the gutter, one tab closer to the building component being shorter than the other tab, each of the tabs having an opening in the upper end thereof, the opening in the other tab being open upwardly, a threaded fastener having a point and head and disposed in the openings with its point directed down toward a portion of the hanger assembly and a gutter portion against the building component, the process including the steps of a. providing the building component, the gutter, and the hanger assembly, b. engaging the head of the fastener with the drive end of a rotary power tool, c. commencing rotation of the power tool, pressing the tool in the direction toward the portion of the hanger to bend the other tab and tap into the gutter portion so that the threaded fastener threads into the gutter portion and into the building component, drawing the fastener away from the other tab, d. continuing rotation of the fastener to cause the head of the fastener to flex the one tab against the hanger portion to serve as a washer and buttress.

3. A gutter hanger comprising a unitary hanger body defined by a flat rectangular element having a upwardly turned hook at one end and an inverted-U-shaped clip at the other end, a pair of spaced free-standing aligned tabs facing the clip end of the hanger body extending up from the rectangular element along a center line thereof, the tabs having openings in their upper ends, the tab closer to the inverted-U-shaped clip being shorter than the other tab, the opening in the other tab being a U-shaped opening having an open top, the openings being adapted to receive a pointed threaded fastener, the pointed end being directed toward the inverted-U-shaped clip.

4. The gutter hanger as claimed in claim 3 wherein the inverted-U-shaped clip comprises an upward leg formed with an aperture and the fastener is directed to the aperture.

5. The gutter hanger as claimed in claim 4 wherein the shorter tab is adapted to be collapsed against the inverted-U-shaped clip when the fastener is moved axially toward the inverted-U-shaped clip, forming a buttress.

6. The gutter hanger as claimed in claim 5 wherein the opening in the shorter tab is U-shaped.

7. The gutter hanger as claimed in claim 3 wherein the opening in the other tab is adapted to release the threaded fastener when the fastener is moved axially toward the inverted-U-shaped clip.

8. The gutter hanger as claimed in claim 7 wherein the opening in the other tab is U-shaped with the legs of the "U" being adapted to partly embrace the fastener.

9. The gutter hanger as claimed in claim 3 including a fastener passing through the openings and the opening in the other tab is U-shaped with the legs of the "U" partly embracing the fastener.

10. A gutter hanger assembly as claimed in claim 1 wherein said opening in said other tab is defined by a paor of upward legs straddling the fastener, the legs being pinched together to hoold the fastener pinched between them.

* * * * *